US011668118B2

(12) United States Patent
Yamaguchi et al.

(10) Patent No.: US 11,668,118 B2
(45) Date of Patent: Jun. 6, 2023

(54) DOOR HANDLE DEVICE FOR VEHICLE

(71) Applicant: KABUSHIKI KAISHA HONDA LOCK, Miyazaki (JP)

(72) Inventors: Yuki Yamaguchi, Miyazaki (JP); Yasuhiro Saitou, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 64 days.

(21) Appl. No.: 17/350,358

(22) Filed: Jun. 17, 2021

(65) Prior Publication Data

US 2021/0396052 A1 Dec. 23, 2021

(30) Foreign Application Priority Data

Jun. 23, 2020 (JP) ..... JP2020-108217

(51) Int. Cl.
*E05B 77/38* (2014.01)
*E05B 85/18* (2014.01)

(52) U.S. Cl.
CPC ..... *E05B 77/38* (2013.01); *E05B 85/18* (2013.01)

(58) Field of Classification Search
CPC ..... E05B 85/10; E05B 85/14; E05B 85/16; E05B 85/18; E05B 1/00; E05B 7/00; Y10T 292/57
See application file for complete search history.

(56) References Cited

U.S. PATENT DOCUMENTS 5,975,594 A * 11/1999 Sandhu ..... E05B 83/30 292/DIG. 31
6,234,041 B1 * 5/2001 Larabet ..... E05B 85/16 74/543

(Continued)

FOREIGN PATENT DOCUMENTS

CN 106285253 A * 1/2017 ..... E05B 85/12
DE 20122422 U1 * 9/2005 ..... E05B 85/18

(Continued)

OTHER PUBLICATIONS

Computer Generated Translation for FR 2802562, https://dialog.proquest.com/professional/cv_2183530/docview/1128478226/183EC36C9A8685D8E80/3?accountid=131444#/eng_1 (Year: 2022).*

(Continued)

*Primary Examiner* — Alyson M Merlino
(74) *Attorney, Agent, or Firm* — Carrier Shende & Associates, P.C.; Joseph P. Carrier; Anne G. Sabourin

(57) ABSTRACT

In a door handle device for a vehicle, an elastic stopper includes: a stopper main body having a receiving surface that can be brought into contact with and separated from one of case and handle members, and being attached to the other member; and a lip part formed integrally with the stopper main body. The stopper main body is formed into a shape capable of alleviating impact by bringing the receiving surface into contact with the one member when the handle member swinging in a closing direction reaches a closed position. The lip part is formed to protrude further toward the one member side than the receiving surface in a free state of the lip part, and can exert a resilient force in a direction where the receiving surface and the one member are separated from each other when the handle member starts open-swing thereof from the closed position.

2 Claims, 7 Drawing Sheets

(56) References Cited

U.S. PATENT DOCUMENTS

| | | | | |
|---|---|---|---|---|
| 6,447,030 | B1 * | 9/2002 | Meinke | E05B 85/16 292/336.3 |
| 6,644,074 | B2 * | 11/2003 | Monig | E05B 79/06 292/DIG. 64 |
| 11,486,170 | B2 * | 11/2022 | Bendel | E05B 85/16 |

FOREIGN PATENT DOCUMENTS

| | | | | |
|---|---|---|---|---|
| EP | 1081319 | A1 * | 3/2001 | E05B 85/18 |
| FR | 2802562 | A1 * | 6/2001 | E05B 85/18 |
| JP | H07-29233 | U | 6/1995 | |
| JP | 2002-188329 | A | 7/2002 | |
| JP | 2008-038378 | A | 2/2008 | |
| KR | 20070031496 | A * | 3/2007 | |

OTHER PUBLICATIONS

Computer Generated Translation for DE 20122422, generated on Nov. 17, 2022, https://worldwide.espacenet.com/ (Year: 2022).*
Official Communication dated Apr. 26, 2022 in the corresponding Chinese Patent Application No. 202110690673.4.
Office Action dated Apr. 5, 2023, in the corresponding Japanese Patent Application No. 2020-108217.

* cited by examiner

DOOR HANDLE DEVICE FOR VEHICLE

CROSS REFERENCE TO RELATED APPLICATIONS

The present application claims priority under 35 U.S.C. § 119 to Japanese Patent Application No. 2020-108217 filed Jun. 23, 2020 the entire contents of which are hereby incorporated by reference.

BACKGROUND OF THE INVENTION

Field of the Invention

The present invention relates to a door handle device, particularly, a door handle device for a vehicle, comprising a case member that is to be fixed to a door main body, a handle member that is pivotally supported on the case member so as to be capable of swinging between a predetermined closed position and a predetermined open position, and an urging device that urges the handle member toward the closed position.

Description of the Related Art

For example, Japanese Patent Application Laid-open No. 2002-188329 discloses an arrangement of the above-mentioned door handle device for a vehicle, in which an elastic stopper capable of holding the handle member at the closed position against the urging device is provided between the handle member and the case member, and when the handle member has reached the closed position, impact can be absorbed and alleviated by utilizing elasticity of the elastic stopper.

In the door handle device of Japanese Patent Application Laid-open No. 2002-188329, when the handle member is at the closed position, the elastic stopper fixed to the case member is in contact with a counterpart member (the handle member). In a process of swing of the handle member for opening (hereinafter called as "open-swing") from the closed position, a stopper extension part (18) of the elastic stopper is continuously rubbed against the handle member so as to be in sliding contact therewith over a predetermined period. Therefore, due to this sliding, a friction force acts to no small extent so as to give unsmooth feeling to an operator, thereby causing a possibility of degrading operation feeling.

FIG. 8 of Japanese Patent Application Laid-open No. 2002-188329 shows a structure (a conventional example) having no stopper extension part mentioned above. However, even in such a structure, there is a case wherein when open-swing of the handle member is started from the closed position, depending on a direction of the swinging displacement and a direction of an elastic stopper (8), the elastic stopper and the handle member are rubbed against each other to some extent to be in sliding contact with each other, and therefore, a friction force acting on the sliding part may give unsmooth feeling to the operator.

SUMMARY OF THE INVENTION

The present invention has been accomplished in light of such circumstances, and it is an object thereof to provide a door handle device for a vehicle, which is capable of solving the above-mentioned problem of the conventional structure with a simple structure.

In order to achieve the object, according to a first aspect of the present invention, there is provided a door handle device for a vehicle, comprising a case member that is to be fixed to a door main body, a handle member that is pivotally supported on the case member so as to be capable of swinging between a predetermined closed position and a predetermined open position, an urging device that urges the handle member toward the closed position, and an elastic stopper that can hold the handle member at the closed position against the urging device, wherein the elastic stopper includes a stopper main body and a lip part formed integrally with the stopper main body, the stopper main body having a receiving surface that can be brought into contact with and separated from either one of the case member and the handle member, the stopper main body being attached to another of the case member and the handle member, the stopper main body is formed into a shape capable of alleviating impact by bringing the receiving surface into contact with the one member when the handle member swinging in a closing direction thereof has reached the closed position, and the lip part is formed so as to protrude further toward the one member side than the receiving surface in a free state of the lip part, the lip part being capable of exerting a resilient force in a direction in which the receiving surface and the one member are separated from each other when the handle member starts open-swing thereof from the closed position.

In accordance with the first aspect of the present invention, the elastic stopper includes the stopper main body and the lip part formed integrally with the stopper main body, the stopper main body having the receiving surface that can be brought into contact with and separated from either one of the case member and the handle member, the stopper main body being attached to the other member, the stopper main body is formed into a shape capable of alleviating impact by bringing the receiving surface into contact with the one member when the handle member swinging in the closing direction thereof has reached the closed position, and the lip part is formed so as to protrude further toward the one member side than the receiving surface in the free state of the lip part, the lip part elastically urging the receiving surface and the one member in a direction of separating them from each other when the handle member starts the open-swing from the closed position. Accordingly, when the handle member starts the open-swing from the closed position, the receiving surface of the elastic stopper and the one member can be swiftly separated from each other due to the resilient force of the lip part, so as to be able to effectively prevent a friction force from acting therebetween. Therefore, it is possible to restrain inconvenience of the friction force giving unsmooth feeling to an operator, thereby becoming advantageous in improving operation feeling of the handle member.

According to a second aspect of the present invention, in addition to the first aspect, the receiving surface includes a specified receiving surface part that displaces relative to the one member in a direction substantially along a contact surface between the receiving surface and the one member when the open-swing is started, and the lip part is formed so as to protrude further toward the one member side than the specified receiving surface part at least in a periphery of the specified receiving surface part in the free state of the lip part.

In accordance with the second aspect of the present invention, the receiving surface includes the specified receiving surface part that displaces relative to the one member in the direction substantially along the contact surface between the receiving surface and the one member when the open-swing of the handle member is started, and the lip part is formed so as to protrude further toward the one member side than the specified receiving surface part at least in the periphery of the specified receiving surface part in the free state of the lip part. Accordingly, when the open-swing is started, even if the specified receiving surface part displaces relative to the one member in the direction substantially along the contact surface between the receiving surface and the one member (and consequently, even in a structure where a friction force is easily generated on the contact surface due to the relative displacement), the specified receiving surface part and the one member can be swiftly separated from each other due to the resilient force of the lip part in the periphery of the specified receiving surface part, thereby making it possible to restrain generation of a friction force.

According to a third aspect of the present invention, in addition to the first or second aspect, the handle member includes an arm part that protrudes toward an inner side of the case member through a first opening provided in the case member, the arm part having a tip part pivotally connected to an inner surface of the case member via a pivot shaft, the stopper main body includes a second opening through which the arm part is inserted, the stopper main body being fixed to a surface, opposing the case member, of the handle member, and the lip part is formed on an entire outer peripheral part of the stopper main body so as to surround the first and second openings.

In accordance with the third aspect of the present invention, the handle member includes the arm part protruding toward the inner side of the case member through the first opening provided in the case member, the tip part of the arm part is pivotally connected to the inner surface of the case member via the pivot shaft, the stopper main body includes the second opening through which the arm part is inserted, the stopper main body being fixed to the surface, opposing the case member, of the handle member, and the lip part is formed on the entire outer peripheral part of the stopper main body so as to surround the first and second openings. Accordingly, compared with a structure with no lip part or a structure with a lip part but not on the entire periphery, air or water hardly passes through each opening, and therefore, it is effective for preventing wind noise due to such passing through, or preventing intrusion of water into an interior of the case member.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention is explained below by reference to the attached drawings.

Figure 1:
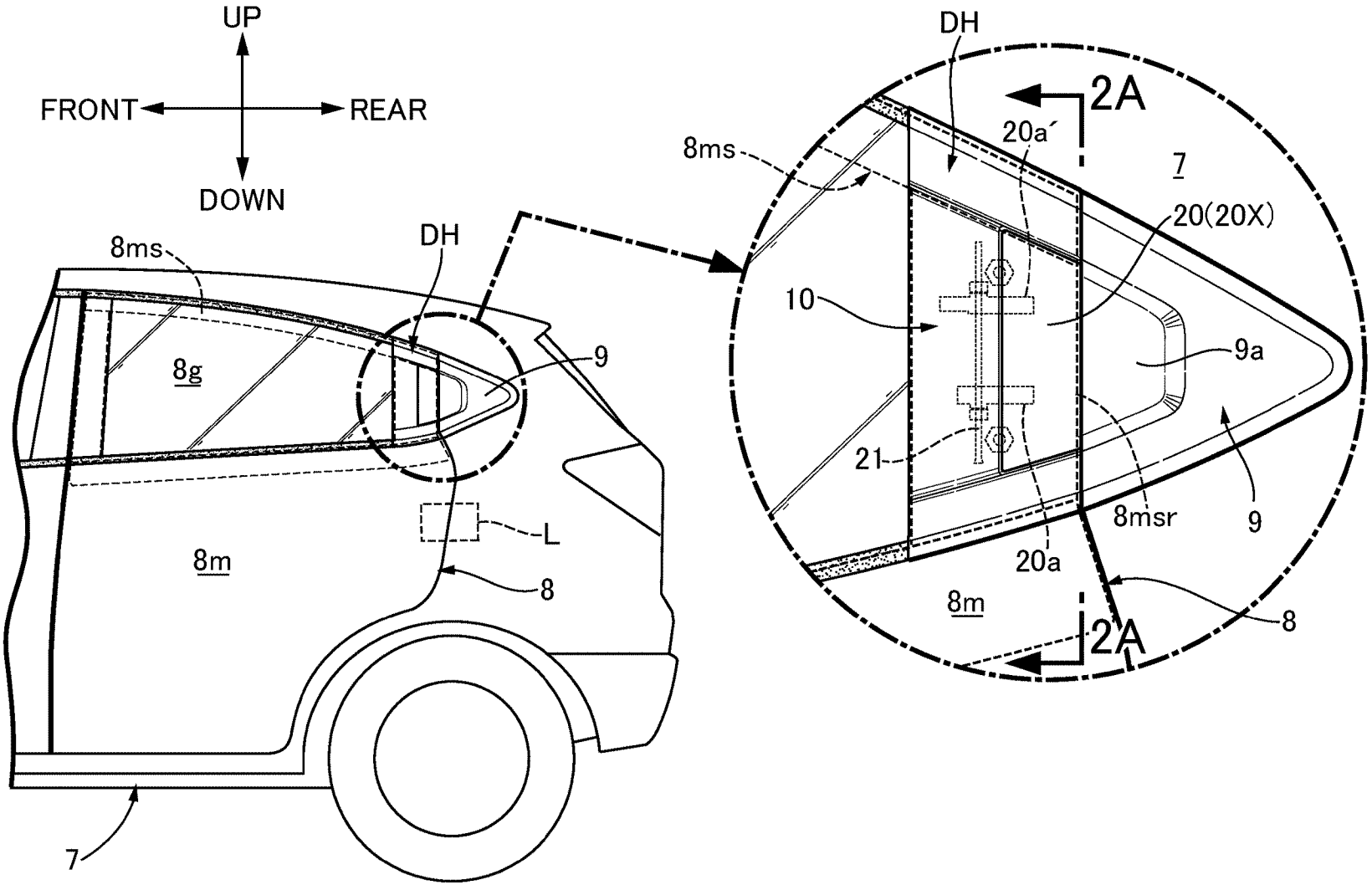
FIG. 1 shows a side view of a rear part of an automobile applied with a door handle device according to an embodiment of the present invention, and also shows an enlarged view of a portion of the rear part.

First, in FIG. 1, front and rear doors are openably and closably mounted on a vehicle body 7 of an automobile as a vehicle so as to respectively close left and right openings of the vehicle body 7. For example, in each of the left and right rear doors 8, a front end part of a door main body 8*m* is hinge-connected to the vehicle body 7, and a rear end part of the door main body 8*m* is engageably and disengageably locked to the vehicle body 7 by a door lock mechanism L provided between the rear end part and the vehicle body 7. It is noted that the door lock mechanism L includes a striker not illustrated, which is fixed to the vehicle body side, and a latch La (schematically illustrated in FIG. 2B) on the door side, the latch La being engageable with and disengageable from the striker, an engagement and disengagement structure between the striker and the latch La is conventionally known.

The rear doors 8 each include the door main body 8*m* with high rigidity, a window pane 8*g* capable of being opened and closed and elevated and lowered on a window frame part 8*ms* in an upper part of the door main body 8*m*, and a door handle device DH for releasing locking of the door lock mechanism L as needed. The door handle device DH is provided at an appropriate place (in the embodiment, a rear edge portion 8*msr* of the window frame part 8*ms*) of the door main body 8*m*. Also referring to FIG. 2A to FIG. 7, one example of the door handle device DH provided on the left rear door 8 is explained below.

The door handle device DH includes a synthetic resin or metal case member 10 (as one member), a synthetic resin or metal handle member 20 (as another member), a return spring 17, and an elastic stopper 30, the case member 10 being fixed to the window frame part 8*ms*, the handle member 20 being pivotally supported on the case member 10 and capable of swinging between a predetermined closed position 20X (positions shown by solid line respectively in FIGS. 3 and 4) and open position 20Y (positions shown by two-dot-chain line respectively in FIGS. 3 and 4), the return spring 17 serving as an urging device that urges the handle member 20 toward the closed position 20X, the elastic stopper 30 being capable of holding the handle member 20 at the closed position 20X against a resilient force of the return spring 17.

It is noted that a decorative panel 9 covers and is fixed to the vehicle body 7 so as to be placed adjacent to a rear side of the door handle device DH, and a guide recess part 9*a* is provided in the decorative panel 9 so as to face an open surface of a finger hooking recess 20*c* opened rearward and provided in the handle member 20, fingers of an operator being to be inserted into the guide recess part 9*a* when opening and closing the handle member 20.

Components of the door handle device DH are sequentially explained below.

The case member 10 is disposed within a recess portion provided in an outer surface of the rear edge portion 8*msr* of the window frame part 8*ms*, and detachably fixed to the rear edge portion 8*msr*. An outer surface of the case member 10 is formed into a shape capable of covering the rear edge portion 8*msr* of the window frame part 8*ms*.

Moreover, the case member 10 has a curved part 10*w* that is curved toward an inner side of the vehicle body so as to correspond to a portion on which the handle member 20 is placed, and a concave curved surface of the curved part 10*w* functions as a handle receiving part, the handle member 20 being housed in the handle receiving part so as to be able to be protruded therefrom and retracted therein. Furthermore, as clearly shown in FIG. 5, a pair of upper and lower first support boss parts 10*b*1, 10*b*1', and a second support boss part 10*b*2 are protruded integrally from an inner surface of the case member 10, the first support boss parts 10*b*1, 10*b*1' being placed adjacent to the curved part 10*w* and protruding toward the inner side of the vehicle body, the second support boss part 10*b*2 being placed between the first support boss parts 10*b*1, 10*b*1' and protruding toward the inner side of the vehicle body.

Bolts 11 are respectively screwed into the first support boss parts 10*b*1, 10*b*1' so as to join the rear edge portion 8*msr* of the window frame part 8*ms* to the first support boss parts 10*b*1, 10*b*1'. Moreover, a shaft member having a bearing surface 12*j* on an outer periphery of an intermediate part thereof, for example, a base part of an insert nut 12, is press-fitted and fixed into the second support boss part 10*b*2, and an intermediate base part 130 of a relay lever 13 is rotatably fitted and supported onto the bearing surface 12*j* of the insert nut 12. The relay lever 13 is prevented from coming off by a coming-off prevention means (for example, a bush 14, and a retaining ring 15 such as a push nut, etc.) provided on a tip end part of the insert nut 12.

It is noted that in place of the insert nut 12, another shaft member (for example, a bolt) having a bearing surface on an outer periphery of an intermediate part thereof and fixed to the case member 10 may be used as a pivot of the relay lever 13.

The relay lever 13 is a main component of an operative connection mechanism I for operatively connecting the swing motion of the handle member 20 for opening and closing with the door lock mechanism L so as to operate engagement and disengagement of the door lock mechanism L. That is, the relay lever 13 integrally has first and second tip part arms 131, 132 extending in different directions respectively from the intermediate base part 130 of the relay lever 13, and particularly, an upper end part of a rod 16 is pivotally supported on and connected to the first tip part arm 131, the rod 16 configuring a part of the operative connection mechanism I and extending substantially in an up-down direction. A lower end part of the rod 16 and the latch La of the door lock mechanism L are operatively connected with each other.

Figure 2A:
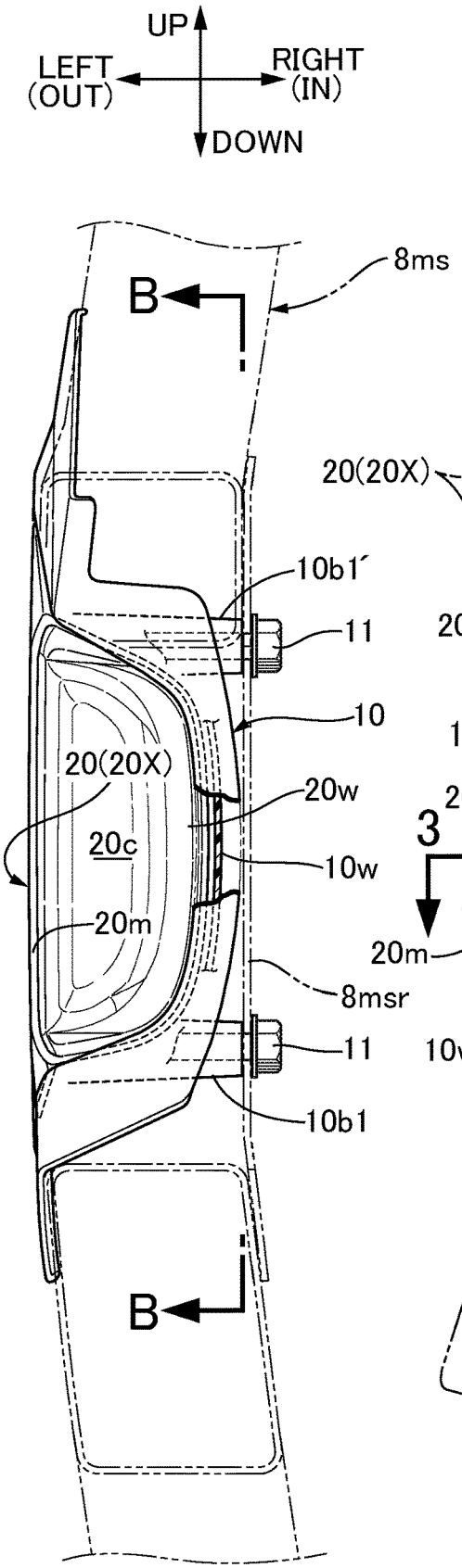
FIG. 2A is a rear view of the door handle device (an enlarged view as seen from arrowed line 2A-2A in FIG. 1)
Figure 2B:
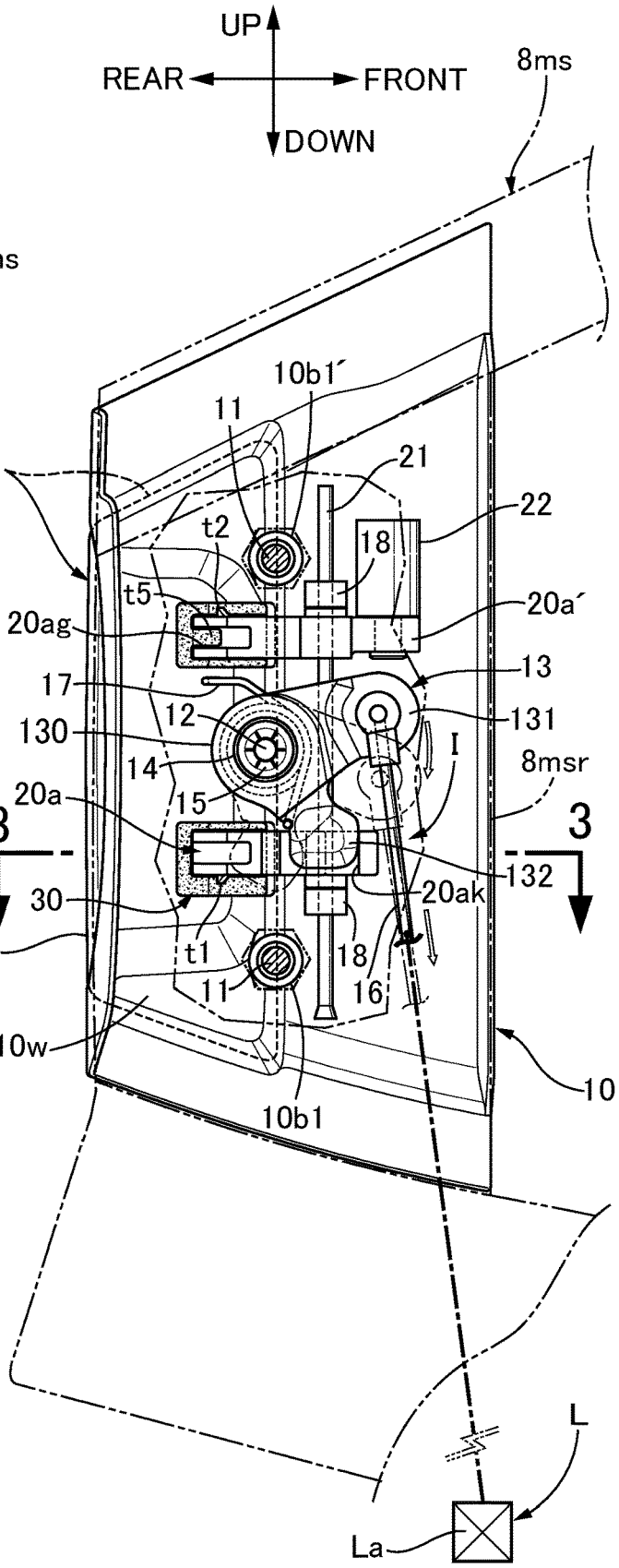
FIG. 2B is a reverse view of the door handle device (a sectional view along line B-B in FIG. 2A).

Moreover, the relay lever 13 is urged to rotate in a counterclockwise direction in FIG. 2B by the resilient force of the return spring 17 (for example, a torsion coil spring) provided between the relay lever 13 and the case member 10. Accordingly, the rod 16 operatively connected with the relay lever 13 is always urged upward (and therefore, in a direction where the latch La is locked to the striker). It is noted that as described later, the resilient force of the return spring 17 also acts on the handle member 20 as an urging force in a closing direction of the handle member 20.

The handle member 20 is explained below. The handle member 20 includes a handle main body 20*m* and a projected wall part 20*w*, the handle main body 20*m* having a band plate shape and extending in the up-down direction, the projected wall part 20*w* being formed on an inner surface of the handle main body 20*m* so as to protrude toward the inner side of the vehicle body and defining the finger hooking recess 20*c* between the projected wall part 20*w* and the handle main body 20*m*. The projected wall part 20*w* is formed into a projected shape substantially following the concave curved surface of the curved part 10*w* of the case member 10.

A pair of arm parts 20*a*, 20*a*' are protruded integrally from a surface (particularly, a front surface part 20*wf*), opposing the curved part 10*w*, of the projected wall part 20*w*, the arm parts 20*a*, 20*a*' protruding toward an inner side (particularly, a front side) of the case member 10 through a pair of upper and lower first openings 10*h* provided in the curved part 10*w*. Tip parts of the arm parts 20*a*, 20*a*' are pivotally supported and connected on the inner surface side of the case member 10 via a hinge pin 21 as a pivot shaft extending in the up-down direction. The hinge pin 21 is fixed to or rotatably fitted and supported into a pair of support arms 18 protruded from the inner surface of the case member 10.

Figure 3:
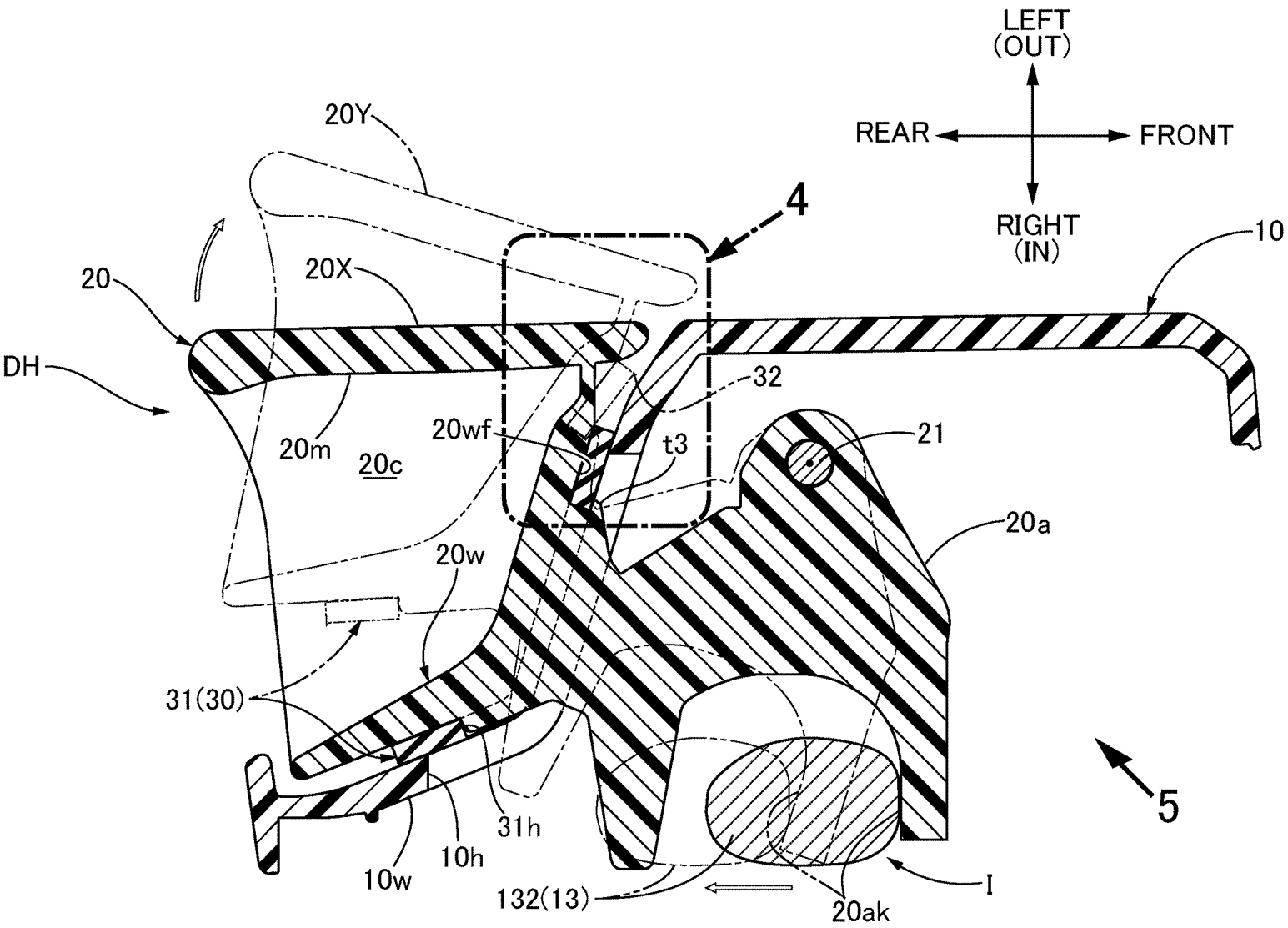
FIG. 3 is an enlarged sectional view along line 3-3 in FIG. 2B.

Thus, the swing motion of the handle member 20 for opening and closing can be performed around the hinge pin 21 between the closed position 20X where the handle member 20 is housed within the handle receiving part (that is, the concave curved surface of the curved part 10*w*) and the open position 20Y where the handle member 20 protrudes outward from the closed position 20X, and particularly, when being at the closed position 20X, the handle member 20 is arranged so that an outer surface of the handle member 20 is positioned substantially on an extended surface of the outer surface of the case member 10 as clearly shown by solid line in FIG. 3.

A fork-shaped engagement arm portion 20*ak* is formed at a tip part of the arm part 20*a* as one (in the embodiment, the lower one) of the upper and lower arm parts, the engagement arm portion 20*ak* being slidably engaged with the second tip part arm 132 of the relay lever 13 mentioned above. Due to such engagement between the second tip part arm 132 and the engagement arm portion 20*ak*, the handle member 20 and the relay lever 13 are operatively connected with each other, and an urging force of the return spring 17 always acts on the handle member 20 in the closing direction via the relay lever 13.

Therefore, when the handle member 20 is elastically urged toward and held at the closed position 20X by the urging force of the return spring 17, as clearly shown by solid line in FIG. 2B, the first tip part arm 131 of the relay lever 13 is held at an upward swing limit by the return spring 17, and the latch La continuous to the relay lever 13 is held in a state of being locked to the striker, so that the rear door 8 is prevented from being opened unnecessarily.

On the other hand, from the locked state mentioned above, when the handle member 20 is operated to perform open-swing from the closed position 20X against the urging force of the return spring 17, as clearly shown by two-dot-chain line in FIGS. 2B and 3, due to the second tip part arm 132 following the engagement arm portion 20*ak* of the arm part 20*a*, the relay lever 13 rotates in a clockwise direction in FIG. 2B, and accordingly, the first tip part arm 131 of the relay lever 13 pushes down the rod 16 so that the latch La is separated from the striker. Thus, the locked state of the door lock mechanism L is released so as to enable the rear door 8 to be opened.

It is noted that as needed, a counterweight 22 is fixed to (for example, press-fitted and screwed into) the tip part of the arm part 20*a'*.

One example of the elastic stopper 30 is specifically explained below referring particularly to FIGS. 3 to 7. The elastic stopper 30 includes a stopper main body 31 and a lip part 32 formed integrally with the stopper main body 31, the stopper main body 31 having a receiving surface 31*f* and being attached to the handle member 20 (particularly, the projected wall part 20*w*), the receiving surface 31*f* being capable of being brought into contact with and separated from the case member 10 (particularly, the curved part 10*w*), and the entire elastic stopper 31 is integrally molded from an elastic material, for example, a rubber material. The receiving surface 31*f* is brought into contact with the case member 10 (particularly, the curved part 10*w*) when the handle member 20 is at the closed position 20X, so that the handle member 20 can be held at the closed position 20X against the urging force of the return spring 17.

The stopper main body 31 has a pair of second openings 31*h* through which the pair of arm parts 20*a*, 20*a*' are inserted respectively, the stopper main body 31 being formed into a plate shape following the surface, opposing the curved part 10*w*, of the projected wall part 20*w*. Moreover, the stopper main body 31 has a shape such that when the handle member 20 swinging in the closing direction reaches the closed position 20X, the receiving surface 31*f* is brought into surface contact with the case member 10 (more specifically, the concave curved surface of the curved part 10*w*) so as to exhibit compression resistance, thereby making it possible to absorb and alleviate impact at the time of the contact.

Accordingly, the stopper main body 31 is formed into a squared U-shape having: first and second receiving parts 311, 312 respectively surrounding the pair of second openings 31*h*; and a third receiving part 313 integrally connecting the first and second receiving parts 311, 312 to each other and extending in a band shape in the up-down direction. Furthermore, the stopper main body 31 has an intermediate part thereof (that is, boundary portions respectively between the first and second receiving parts 311, 312 and the third receiving part 313) formed bent so as to correspond to a bending portion of the surface of the projected wall part 20*w*.

On the other hand, the lip part 32 is formed on an entire outer peripheral part on the receiving surface 31*f* side of the stopper main body 31 (therefore, so as to surround the pair of second openings 31*h*). Moreover, the lip part 32 is formed so as to protrude further toward the case member 10 side than the receiving surface 31*f* in a free state of the lip part 32. At least part of the lip part 32 is placed in pressure contact with the case member 10 when the handle member 20 is at the closed position 20X, said at least part of the lip part 32 exerting a resilient force in a direction in which the receiving surface 31*f* and the case member 10 are separated from each other when the handle member 20 starts open-swing thereof from the closed position 20X.

Figure 4:
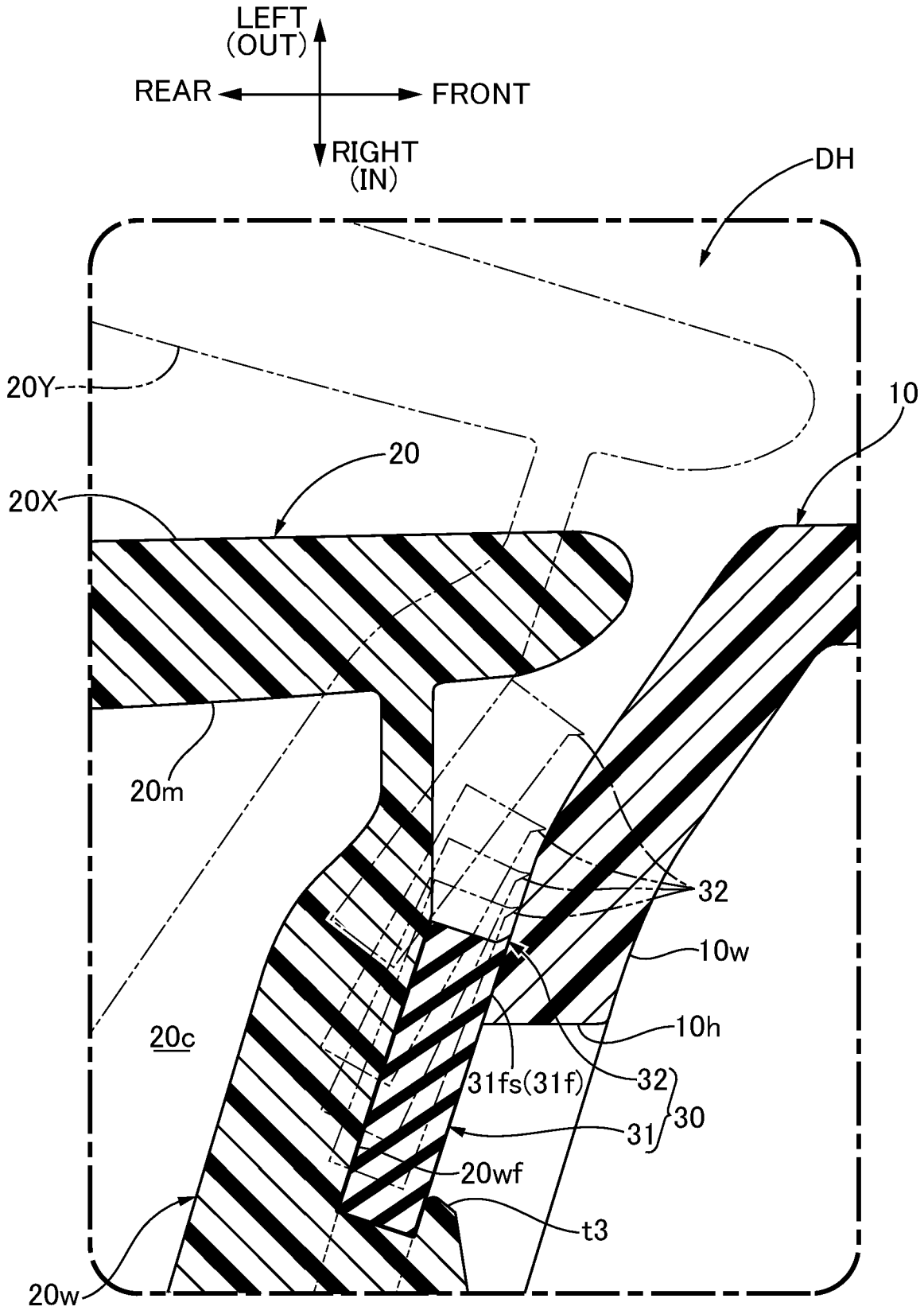
FIG. 4 is an enlarged sectional view of a part indicated by arrow 4 in FIG. 3.
Figure 5:
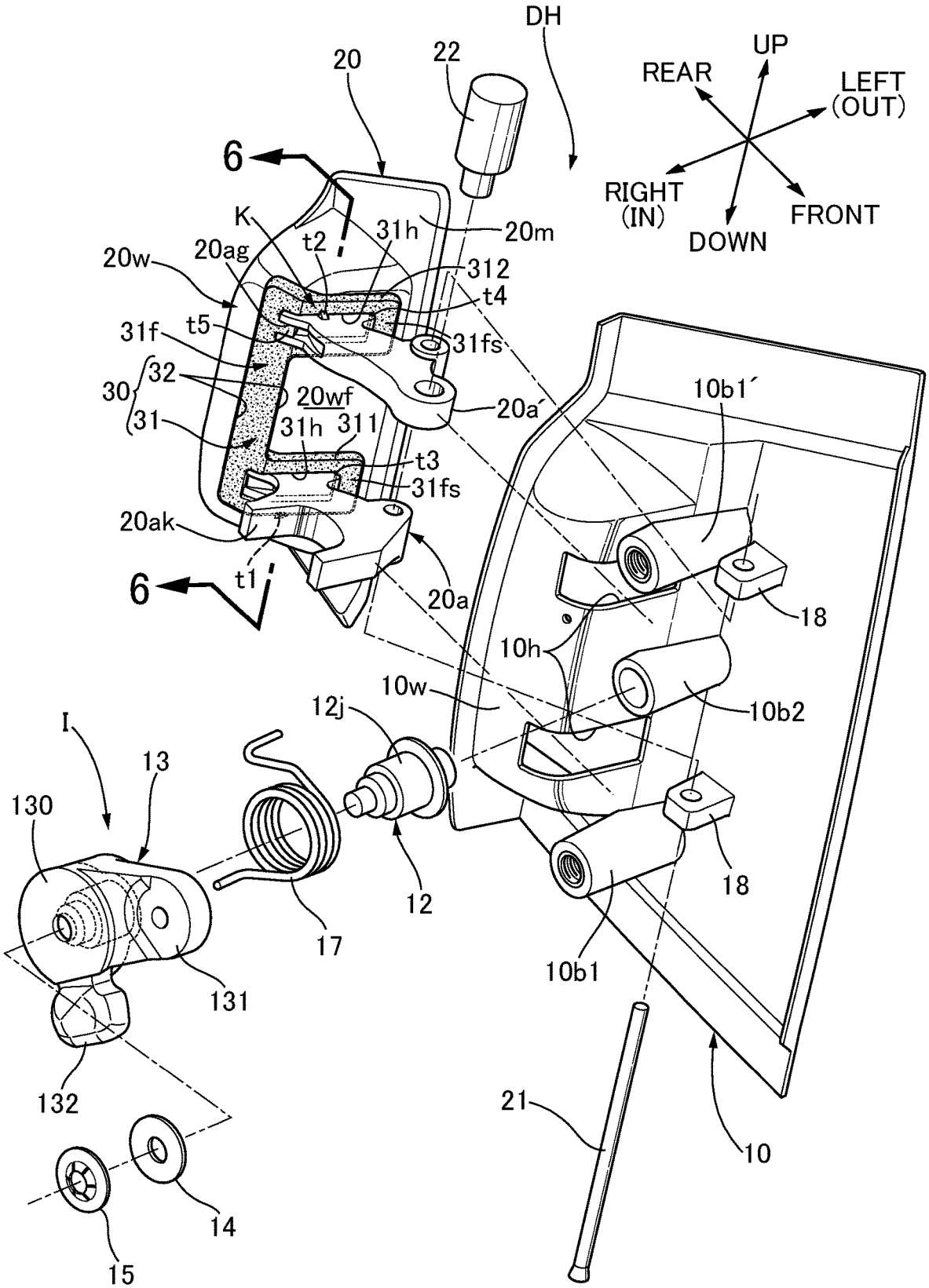
FIG. 5 is an exploded perspective view of the door handle device in a state where an elastic stopper has been attached to a handle member (an exploded perspective view as seen from arrow 5 in FIG. 3).
Figure 6:
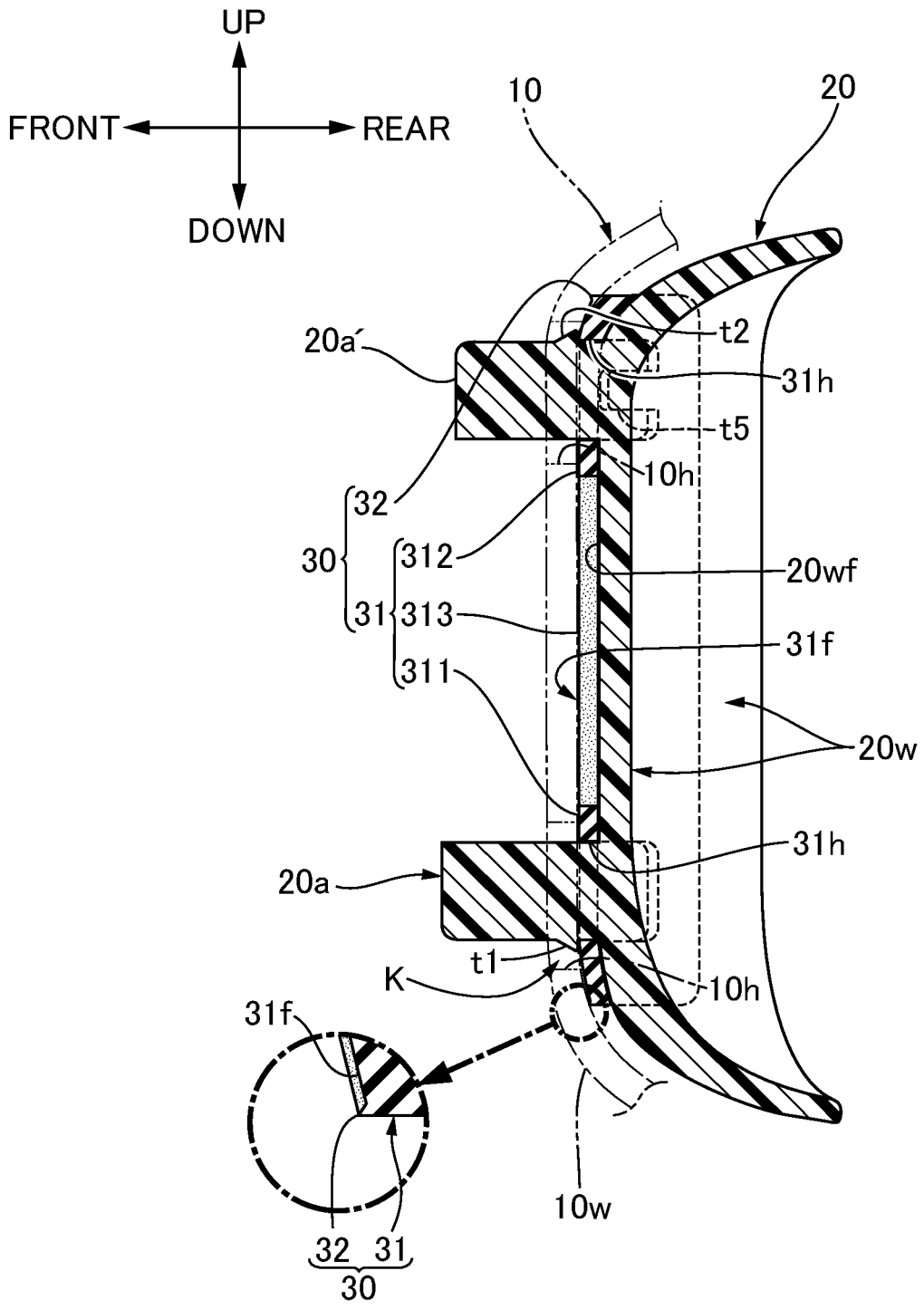
FIG. 6 is an enlarged sectional view along line 6-6 in FIG. 5.

The receiving surface 31*f* of the stopper main body 31 includes a specified receiving surface part 31*fs* that displaces relative to the curved part 10*w* of the case member 10 in a direction substantially along a contact surface between the receiving surface 31*f* and the case member 10 (that is, substantially in a tangential direction, on the contact surface mentioned above, of an arc having an axis of the hinge pin 21 as a center) when the open-swing of the handle member 20 is started, as clearly shown in FIG. 4. In the present embodiment, the specified receiving surface part 31*fs* corresponds to a flat surface portion in a part, included in each of the first and second receiving parts 311, 312, of the receiving surface 31*f*, and positioned further on the outer side of the vehicle body than each of the second openings 31*h*.

Figure 7:
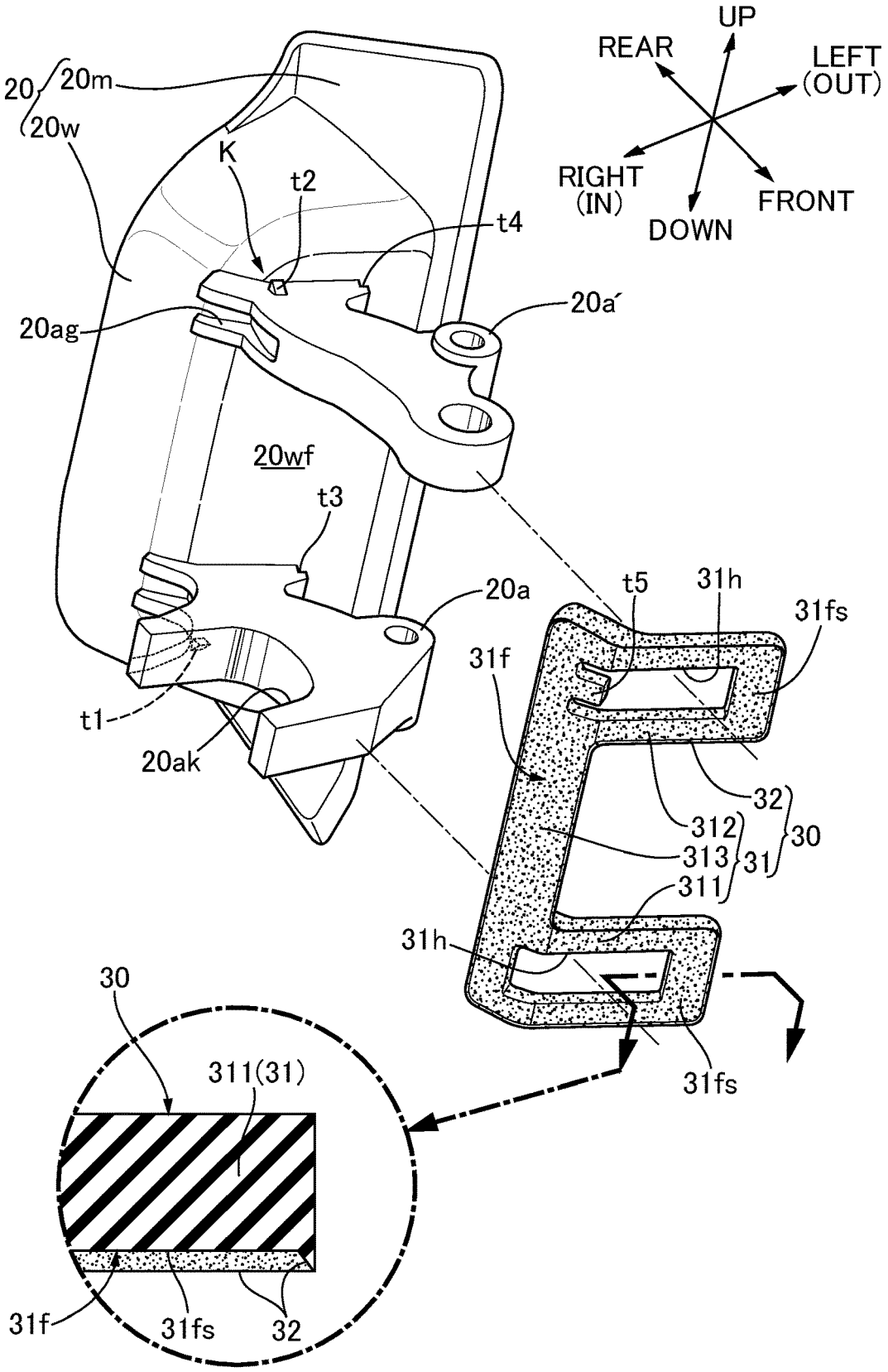
FIG. 7 is an exploded perspective view, as enlarged and shown in the same direction as FIG. 5, illustrating a state where the elastic stopper has been separated from the handle member.

As is clear from FIGS. 4 and 7, in the periphery of the specified receiving surface parts 31*fs*, the lip part 32 is formed so as to protrude further toward the case member 10 side than the specified receiving surface parts 31*fs* in the free state of the lip part 32.

A lock mechanism K is provided between the elastic stopper 30 and the handle member 20, the lock mechanism K being for fixing the elastic stopper 30 to the handle member 20 by engageably and disengageably locking the elastic stopper 30 to the handle member 20. The lock mechanism K includes locking claws t1, t2, and locking claws t3, t4, the locking claws t1, t2 being protruded from outer side surfaces of base parts of the arm parts 20*a*, 20*a*', respectively, the first and second receiving parts 311, 312 of the stopper main body 31 being sandwiched between the projected wall part 20*w* and the locking claws t1, t2, respectively, the locking claws t3, t4 being protruded from one end surfaces of base parts of the arm parts 20*a*, 20*a*', respectively, the first and second receiving parts 311, 312 of the stopper main body 31 being sandwiched between the projected wall part 20*w* and the locking claws t3, t4, respectively.

Moreover, a retaining claw t5 is protrusively provided at a peripheral edge part of the second opening 31*h* of the second receiving part 312, the retaining claw t5 being press-fitted into a groove portion 20*ag* formed in the other end surface of the base part of the corresponding arm part 20*a*'. Due to the retaining claw t5 being press-fitted into the groove portion 20*ag*, the elastic stopper 30 is more securely fixed to the handle member 20.

The operation of the embodiment is now explained.

The elastic stopper 30 is assembled in advance to the handle member 20 prior to assembling the handle member 20 to the case member 10. In the assembling process, the stopper main body 31 of the elastic stopper 30 is pressed against the surface of the projected wall part 20*w* of the handle member 20 while the arm parts 20*a*, 20*a*' are fitted through the second openings 31*h* of the stopper main body 31. At that time, the first and second receiving parts 311, 312 of the stopper main body 31 are clamped respectively between the projected wall part 20*w* and the locking claws t1 to t4 of the base parts of the arm parts 20*a*, 20*a*' while the first and second receiving parts 311, 312 are elastically deformed. Additionally, when the retaining claw t5 at the peripheral edge part of the second opening 31*h* of the second receiving part 312 is press-fitted into the groove portion 20*ag* of the base part of the arm part 20*a*', it is possible to more securely restrain floating or deviation of the elastic stopper 30 from the handle member 20.

The handle member 20 thus attached with the elastic stopper 30 is assembled to the case member 10 so as to assemble the door handle device DH. In a state where the door handle device DH is set on the rear door 8, the handle member 20 and the latch La of the door lock mechanism L are operatively connected with each other via the relay lever 13 and the rod 16. At this time, the return spring 17 linked to the relay lever 13 usually urges elastically and holds the handle member 20 toward and at the closed position 20X, and also holds the latch La in the locked state to the striker, thereby preventing the rear door 8 from being opened unnecessarily.

On the other hand, from the locked state mentioned above, when the handle member 20 is operated to perform the open-swing from the closed position 20X against the urging force of the return spring 17, the latch La operatively connected with the handle member 20 via the relay lever 13 and the rod 16 can be separated from the striker, thereby enabling the rear door 8 to be opened.

Moreover, when a hand of an operator is released from the handle member 20 which is in an opening operation state, the handle member 20 performs close-swing by the urging force of the return spring 17. When the handle member 20 reaches the closed position 20X, at least part of the receiving surface 31*f* of the elastic stopper 30 is brought into contact with the case member 10 (the concave curved surface of the curved part 10*w*), so that the handle member 20 is held at the closed position 20X. Moreover, impact at the time of said contact is shock-absorbingly received mainly due to compression resistance of the stopper main body 31.

According to the present embodiment, the elastic stopper 30 includes: the stopper main body 31 attached to the handle member 20 and having the receiving surface 31*f* capable of being brought into contact with or separated from the case member 10; and the lip part 32 formed integrally with the stopper main body 31, the stopper main body 31 being formed into a plate shape such that when the handle member 20 swinging in the closing direction reaches the closed position 20X, the receiving surface 31*f* is brought into contact with the case member 10 so as to be able to alleviate impact due to the contact. On the other hand, the lip part 32 is formed so as to protrude further toward the case member 10 side than the receiving surface 31*f* in the free state of the lip part 32, the lip part 32 having a configuration capable of elastically urging the receiving surface 31*f* and the case member 10 in the direction of separating them from each other when the handle member 20 starts the open-swing from the closed position 20X.

In this case, when the handle member 20 is at the closed position 20X, the entire receiving surface 31*f* may be brought into contact with the case member 10, or as in the present embodiment, part (for example, most part including the specified receiving surface parts 31*fs*) of the receiving surface 31*f* may be brought into contact with the case member 10. When the handle member 20 is at the closed position 20X, in the periphery of the receiving surface 31*f* being in contact with the case member 10, the lip part 32 is elastically deformed by receiving a reaction force from the case member 10.

Accordingly, when the handle member 20 starts the open-swing from the closed position 20X, the receiving surface 31*f* of the elastic stopper 30 and the case member 10 can be swiftly separated from each other due to the resilient force of the lip part 32, so as to be able to effectively prevent a friction force from acting therebetween. Therefore, it is possible to restrain inconvenience of the friction force giving unsmooth feeling to an operator, thereby becoming advantageous in improving operation feeling of the handle member 20.

Moreover, particularly, the receiving surface 31 of the present embodiment includes the specified receiving surface parts 31*fs* that displace relative to the curved part 10*w* of the case member 10 in the direction substantially along the contact surface between the receiving surface 31*f* and the case member 10 (that is, substantially in the tangential direction, on the contact surface mentioned above, of the arc having the axis of the hinge pin 21 as a center) when the open-swing of the handle member 20 is started, as clearly shown in FIG. 4. The lip part 32 is formed so as to protrude further toward the case member 10 side than the specified receiving surface parts 31*f* in the periphery of the specified receiving surface parts 31*fs*, in the free state of the lip part 32.

Accordingly, when the open-swing is started, even if the specified receiving surface parts 31*fs* displace relative to the case member 10 in the direction substantially along the contact surface between the receiving surface 31*f* and the case member 10 (and therefore, even in a structure where a friction force is easily generated on the contact surface due to the relative displacement), the specified receiving surface parts 31*f* and the case member 10 can be swiftly separated from each other due to the resilient force of the lip part 32 in the periphery of the specified receiving surface parts 31*f*, thereby making it possible to restrain generation of a friction force.

Moreover, the handle member 20 has the arm parts 20*a*, 20*a*' protruding toward the inner side of the case member 10 through the first openings 10*h* of the case member 10, the tip parts of the arm parts 20*a*, 20*a*' are pivotally connected to the inner surface of the case member 10 via the hinge pin 21, the stopper main body 31 has the second openings 31*h* through which the arm parts 20*a*, 20*a*' are inserted respectively, the stopper main body 31 being fixed to the surface, opposing the case member 10, (that is, the front surface part 20*wf* of the projected wall part 20*w*) of the handle member 20, and the lip part 32 is formed on the entire outer peripheral part of the stopper main body 31 so as to surround the first and second openings 10*h*, 31*h*.

Accordingly, compared with a structure with no lip part 32 or a structure with the lip part 32 but not on the entire periphery, air or water hardly passes through each of the openings 10*h*, 31*h*, and therefore, it is effective for preventing wind noise due to such passing through, or preventing intrusion of water into an interior of the case member 10.

An embodiment of the present invention is explained above, but the present invention is not limited to the above-mentioned embodiment and may be modified in a variety of ways as long as the modifications do not depart from the gist of the present invention.

For example, in the embodiment, the door handle device DH is provided on the rear door 8, but may be provided on the front door. Moreover, the door handle device DH of the embodiment is provided on the rear edge portion 8*msr* of the window frame part 8*ms* of the rear door 8, but may be provided at another place, for example, the door main body 8*m* immediately below the window pane 8*g*. Additionally, the door to be provided with the door handle device DH is not limited to a swing opening and closing type as in the embodiment, but may be of a slide opening and closing type.

Furthermore, in the embodiment, the lip part 32 is formed on the entire outer peripheral part of the stopper main body 31 of the elastic stopper 30, but may be formed only on a part in the peripheral direction of the outer peripheral part of the stopper main body 31. Moreover, in a case where the lip part 32 is formed over the entire periphery, the lip part 32 may be brought into contact with the case member 10 over the entire periphery, or only a part in the peripheral direction of the lip part 32 may be brought into contact with the case member 10.

Furthermore, in the embodiment, the return spring 17 of the relay lever 13 serves also as a return spring of the handle member 20, but a return spring that directly urges the handle member 20 toward the closed position 20X side may be provided between the handle member 20 and the case member 10.

Furthermore, in the embodiment, the lip part 32 has a tapered lip shape, but may have at least a shape capable of elastically urging the receiving surface 31*f* of the elastic stopper 30 and the case member 10 in a direction of separating them from each other, and thus, the lip part 32 is not necessarily required to have a tapered shape as in the embodiment, and for example, may have a shape such that a tip end part of the lip part 32 has a cross section curved into an arc shape.

Furthermore, in the embodiment, the elastic stopper 30 is formed into a shape of a plate with a squared U-shape, but the shape of the elastic stopper 30 is not limited to the embodiment, and may be selected from various shapes (for example, a rectangular plate shape, an elliptic plate shape, a polygonal plate shape except for a quadrangular shape, etc.) that at least can achieve a stopper function capable of holding the handle member 20 at the closed position 20X against the resilient force of the return spring 17.

Furthermore, in the embodiment, the elastic stopper 30 is attached to the surface, opposing the case member 10, of the handle member 20 so as to be separatably brought into contact with the case member 10, but the elastic stopper 30 may be attached to the surface, opposing the handle member 20, of the case member 10 in a manner opposite to that in the embodiment, so as to be separatably brought into contact with the handle member 20.

What is claimed is:

1. A door handle device for a vehicle, the door handle device comprising a case member that is to be fixed to a door main body, a handle member that is pivotally supported on the case member so as to be capable of swinging between a predetermined closed position and a predetermined open position, an urging device that urges the handle member toward the predetermined closed position, and an elastic stopper capable of holding the handle member at the predetermined closed position against the urging device, the elastic stopper includes a stopper main body and a lip part formed integrally with the stopper main body, the stopper main body having a receiving surface that is capable of being brought into contact with and separated from the case member, the stopper main body being attached to the handle member, the stopper main body is shaped so as to be capable of alleviating impact by bringing the receiving surface into contact with the case member when the handle member is swung toward and reaches the predetermined closed position, the lip part is formed so as to protrude further toward the case member than the receiving surface in a free state of the lip part, the lip part being capable of exerting a resilient force in a direction in which the receiving surface and the case member are separated from each other when the handle member starts to swing toward the predetermined open position from the predetermined closed position, wherein the handle member includes an arm part that protrudes toward an inner side of the case member through a first opening provided in the case member, the arm part having a tip part pivotally connected to an inner surface of the case member via a pivot shaft, the stopper main body includes a second opening through which the arm part is inserted, the stopper main body being attached to a surface, opposing the case member, of the handle member, and the lip part is formed on an entire outer peripheral part of the stopper main body so as to surround the first and second openings.

2. The door handle device for a vehicle according to claim 1, wherein the receiving surface includes a specified receiving surface part that displaces relative to the case member in a direction substantially along a contact surface between the receiving surface and the case member when the handle member begins to swing toward the predetermined open position, and the lip part is formed so as to protrude further toward the case member than the specified receiving surface part at least in a periphery of the specified receiving surface part in the free state of the lip part.

* * * * *